United States Patent [19]

Richardson

[11] Patent Number: 4,529,534

[45] Date of Patent: Jul. 16, 1985

[54] PEROXYACID BLEACH COMPOSITIONS

[75] Inventor: David L. Richardson, Cincinnati, Ohio

[73] Assignee: The Procter & Gamble Company, Cincinnati, Ohio

[21] Appl. No.: 409,735

[22] Filed: Aug. 19, 1982

[51] Int. Cl.[3] ..... C11D 7/18; C11D 7/56; C11D 3/395; D06L 3/00

[52] U.S. Cl. ..... 252/100; 252/95; 252/102; 252/186.1; 252/186.26; 252/186.42; 252/DIG. 1; 260/96.5 C; 260/96.5 R

[58] Field of Search ..... 252/186, 95, 102, 186.26, 252/186.42, DIG. 1; 260/96.5 R, 96.5 C

[56] References Cited

U.S. PATENT DOCUMENTS

| | | | |
|---|---|---|---|
| 2,347,434 | 4/1944 | Reichert | 260/502 |
| 3,167,513 | 1/1965 | Van Embden et al. | 252/99 |
| 3,336,221 | 8/1967 | Ralston | 210/58 |
| 3,414,593 | 12/1968 | Robson | 260/400 |
| 3,542,918 | 11/1970 | Berth et al. | 424/62 |
| 3,645,670 | 2/1972 | Kowalski | 8/139 |
| 3,740,187 | 6/1973 | Kowalski | 8/11 |
| 3,766,078 | 10/1973 | Kowalski | 252/186 |
| 3,860,391 | 1/1975 | Kling et al. | 8/111 |
| 4,013,581 | 3/1977 | Huber | 252/186 |
| 4,051,058 | 9/1977 | Bowing, et al. | 252/186 |
| 4,100,095 | 7/1978 | Hutchins et al. | 252/99 |
| 4,111,826 | 9/1978 | Leigh et al. | 252/89 |
| 4,128,495 | 12/1978 | McCrudden | 252/186 |
| 4,225,452 | 9/1980 | Leigh | 252/102 |
| 4,244,884 | 1/1981 | Hutchins et al. | 260/502 R |
| 4,259,200 | 3/1981 | Sims et al. | 252/102 |
| 4,279,769 | 7/1981 | Yagi et al. | 252/186 |
| 4,294,575 | 10/1981 | Kowalski | 8/111 |
| 4,304,762 | 12/1981 | Leigh | 423/272 |
| 4,325,828 | 4/1982 | Postlethwaite | 252/102 |
| 4,378,300 | 3/1983 | Gray | 252/99 |
| 4,391,723 | 7/1983 | Bacon et al. | 252/900 |
| 4,391,725 | 7/1983 | Bossu | 252/99 |
| 4,417,994 | 11/1983 | Stoddart | 252/99 X |
| 4,422,950 | 12/1983 | Kemper et al. | 252/95 X |
| 4,430,243 | 2/1984 | Bragg | 252/102 X |
| 4,450,089 | 5/1984 | Broze et al. | 252/174.13 X |
| 4,455,249 | 6/1984 | Broze et al. | 252/174.13 X |
| 4,473,507 | 9/1984 | Bossu | 260/502 |

FOREIGN PATENT DOCUMENTS

| | | |
|---|---|---|
| 0003861 | 9/1979 | European Pat. Off. . |
| 37146 | 10/1981 | European Pat. Off. . |
| 40038 | 11/1981 | European Pat. Off. . |
| 47015 | 3/1982 | European Pat. Off. . |
| 1355855 | 6/1974 | United Kingdom . |
| 1387167 | 3/1975 | United Kingdom . |
| 1392284 | 4/1975 | United Kingdom . |
| 1456591 | 11/1976 | United Kingdom . |

OTHER PUBLICATIONS

U.S. Ser. No. 302,278 to Bacon et al., filed 9/15/81.
U.S. Ser. No. 275,568 to Bossu et al., filed 6/22/81.

*Primary Examiner*—John E. Kittle
*Assistant Examiner*—Mukund J. Shah
*Attorney, Agent, or Firm*—Richard C. Witte; Ronald L. Hemingway

[57] ABSTRACT

Surface active peroxyacid bleaches (e.g., perlauric acid) are protected against decomposition caused by presence of magnesium ions in aqueous solutions of said bleaches, by the presence of certain aminophosphonic acid and aminocarboxylic acid chelating agents.

11 Claims, No Drawings

PEROXYACID BLEACH COMPOSITIONS

FIELD OF THE INVENTION

The invention relates to organic peroxyacid bleach compositions and the use of certain aminophosphonate and aminocarboxylate chelator compounds therein. The chelator compounds retard decomposition and/or deactivation of the bleach by magnesium or magnesium and calcium ions in the bleaching bath.

BACKGROUND

Organic peroxyacid bleaches are well known in the art. At moderate washing temperatures (e.g., 15°-52° C.) they are generally more effective in removing stains from fabrics than are the inorganic peroxide bleaches such as sodium perborate, sodium percarbonate, etc., and they are generally more safe to delicate fabrics and to fabric dyes than hypochlorite bleaches such as sodium hypochlorite and sodium dichlorocyanurate.

Among the organic peroxyacid bleaches, it has been found that those which have a long hydrocarbyl chain with the percarboxylate group at one end (e.g., perlauric acid) tend to be more effective (on an equal available oxygen basis) in bleaching of hydrophobic stains from fabrics than those which are not structured in this way, e.g., peroxybenzoic acid and diperoxydodecanedioic acid.

The long chain peroxyacids with the percarboxylate groups at one end have a structure similar to surface active agents (surfactants). It is believed that in a washing solution, their hydrophobic "tail" tends to be attached to the hydrophobic stains on the fabrics, thereby causing a localized increase in bleach concentration around the stain and thus resulting in increased efficiency in bleaching for a given concentration of active oxygen in the bleaching solution.

Peroxyacids having a long hydrocarbyl chain ($C_8$ to $C_{22}$) with the percarboxyl group at one end will be referred to herein as "surface active" peroxyacid bleaches. By contrast, peroxyacids which have a long hydroxycarbyl chain and a peroxyacid group at each end (e.g., diperoxydodecanedioic acid) are not considered to be surface active.

When peroxyacid bleaches are dissolved in a bleaching liquor in the presence of stained fabrics and hardness ions (i.e., calcium and magnesium) some of the available oxygen is lost from the bleaching process because of decomposition and/or deactivation.

The primary objective of the present invention is to provide means to inhibit the decomposition and/or deactivatoion of surface active peroxyacid bleaches and thereby increase the proportion of available oxygen which can be utilized in the bleaching process.

SUMMARY OF THE INVENTION

The invention comprises dry bleaching compositions comprising from about 0.8% to about 25% of a surface active peroxyacid bleach and from about 0.1% to about 2% of an organic chelating agent, as hereinafter defined.

DETAILED DESCRIPTION OF THE INVENTION

In accordance with the present invention it has been found that dry compositions comprising a surface active peroxyacid bleach and a relatively small quantity of certain organic chelating agents have improved bleaching effectiveness in laundry bleaching solutions which contain magnesium hardness ions. The tendency of the peroxyacid to be decomposed/deactivated in solution by the presence of magnesium ions or magnesium plus calcium ions is significantly reduced by the chelating agent. This reduction in decomposition and/or deactivation results in a corresponding increase in the bleaching efficiency of the peroxyacid compound.

The chelating agents, themselves, are also effective on decolorizing hydrophilic stains on which the surface active peroxyacid bleaches are less effective. Surface active bleaches are most effective on hydrophobic soils and stains. Thus, the combination of the chelating agent plus surface active peroxyacid is more effective on the broad range of stain types than either component itself.

The compositions are primarily intended for use in bleaching liquors which contain typical laundering detergents comprising anionic surfactants and polyphosphate builders.

In its composition aspect, the present invention can be described as:

A dry granular bleaching composition comprising:

A. from about 0.8% to about 25% of the surface active peroxyacid bleach, as hereinafter defined; and B. from about 0.1% to about 2% of an organic chelating agent, as hereinafter defined. All percentages and proportions herein are "by weight" unless specified otherwise.

The composition is especially useful when diluted to form a bleaching liquor containing from about 1 ppm to about 20 ppm available oxygen in water which contains from about 17 ppm to about 340 ppm of magnesium ion, at least about 150 ppm anionic surfactant and an amount of an inorganic polyphosphate builder which is from about 0.3 to about 2 times the theoretical stoichiometric equivalent of the total amount of magnesium and calcium (if any) hardness ions in the solution.

SURFACE ACTIVE PEROXYACID BLEACHES

The surface active peroxyacid bleaches of the present invention are compounds having the following formula:

$$R_1CO_3H$$

wherein $R_1$ is an alkyl group containing from 7 to about 21 carbon atoms, preferably from about 9 to about 13 carbon atoms.

These compounds are well known in the art and can be conveniently prepared by the peroxidation of the corresponding aliphatic carboxylic acid. Typically the aliphatic carboxylic acid is reacted with hydrogen peroxide in a solution comprising a mixture of sulfuric acid and water [See U.S. Pat. No. 2,813,965, Krimm, issued Nov. 19, 1957; U.S. Pat. No. 4,244,884, Hutchins et al., issued Jan. 13, 1981; and Parker et al., *J. Am. Chem. Soc.*, 77, 4037, (1957)].

Examples of these compounds are peroxycapric acid, peroxylauric acid, peroxymyristic acid, peroxypalmitic acid, and peroxystearic acid.

For use in the dry bleach compositions of the present invention, the peroxyacid bleaches are preferably converted to adducts (also called inclusion complexes) with urea. In the adducted form the bleaches have sufficient chemical stability to be formulated into dry compositions which can be shipped and stored prior to use by the consumer. These adducts can be prepared by treating the peroxyacid bleach with urea in any known way for preparing adducts, for example, by dry mixing the peroxyacid with the urea, or conducting the mixing in a solvent such as methanol or water and isolating the adduct which is formed by crystallization or evaporation. The adduct which is obtained is a crystalline solid. The solid is reduced to a particle size of from about 14 to about 65 mesh prior to use. A preferred particle size is from about 14 to about 28 mesh. It has been found that the slower rate of solution of these larger particles retards decomposition effects of magnesium and calcium in the bleaching solution and still provides available oxygen at a rate which is effective for bleaching.

Normally the adduct will comprise about 20% to about 25% by weight peroxyacid. Preferably the amount of peroxyacid in the adduct will be about 25%. See U.S. Pat. No. 3,167,513, Van Emden et al, issued Jan. 26, 1965, incorporated by reference herein. All percentages and proportions herein are "by weight" unless specified otherwise.

The compositions herein generally contain from about 0.8% to about 25% of the surface active peroxyacid bleach.

THE ORGANIC CHELATOR

The organic chelators of the present invention are commercially available compounds and are of two basic types, viz., aminophosphonates and aminocarboxylates. The aminophosphonates of the invention are aminotri(methylphosphonic acid) (ATPA), ethylenediaminetetra(methylphosphonic acid) and diethylenetriaminepenta(methylphosphonic acid). They are sold under the names Dequest 2000, Dequest 2041 and Dequest 2060, by The Monsanto Company, St. Louis, Mo.

These compounds have the following structures:

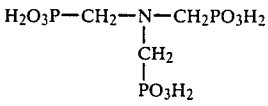

Dequest 2000

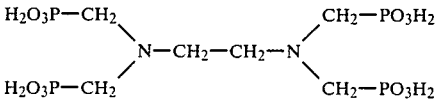

Dequest 2041

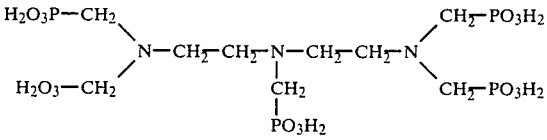

Dequest 2060

The aminocarboxylates of the invention are aminotri(acetic acid) (ATA), ethylenediaminetetra(acetic acid) (EDTA) and diethylenetriaminepenta(acetic acid) (DPTA). These compounds have the following structures:

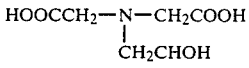

ATA

-continued

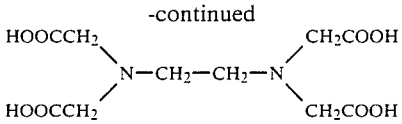

EDTA

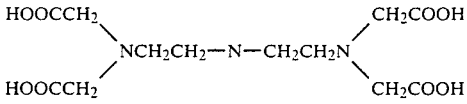

DTPA

In the compositions of the present invention the organic chelator compounds can be used in their acid form, represented by the above formulas, or one or more of the acidic hydrogens can be replaced by an alkali metal ion, e.g., sodium or potassium.

The organic chelators are generally used in the compositions herein at a level such that the weight ratio of organic chelator to available oxygen provided by the surface active peroxyacid bleach is from about 0.025:1 to 20:1, preferably from about 0.4:1 to about 2:1.

COMPOSITION USAGE

The claimed compositions of the present invention are particularly designed to be used in aqueous detergent solutions for the treatment of fabrics, which solutions contain surfactant, inorganic polyphosphate builder and magnesium hardness ions. The amount of anionic surfactant in solution should be at least about 150 ppm, preferably from about 200 ppm to about 400 ppm. The amount of magnesium hardness ions will be from about 17 ppm to about 340 ppm and the amount of inorganic polyphosphate builder will be from about 0.3 to 3 times the theoretical stoichiometric equivalent of the total amount of calcium and magnesium ions in the solution. The compositions of the invention should be used at a level so as to deliver from about 1 to about 20 ppm, preferably from about 5 ppm to about 15 ppm available oxygen to the solution. The amount of organic chelator delivered by the compositions herein to the solution will be sufficient to significantly retard the decomposition and/or deactivation of the surface active bleach by the magnesium ions in the solution.

The organic chelators herein are generally ineffective in retarding the decomposition of nonsurface active bleaches (e.g., diperoxydodecanedioic acid) by magnesium ions.

Calcium hardness ions, which may be present in water used for preparing aqueous bleaching solutions also have decomposition and/or deactivation effects on the surface active peroxyacid bleach. In other words, in the absence of the organic chelators herein, either calcium or magnesium ions will cause significant decomposition/deactivation of the bleach. When the only hardness ion is calcium, the organic chelators herein are relatively ineffective in stabilizing the surface active peroxyacid bleaches against the decomposition/deactivation effects of calcium. When magnesium ions, or magnesium ions and calcium ions are present in the bleaching solution, the chelators herein are effective in retarding the decomposition/deactivation effects of the magnesium ions on the bleach.

As indicated previously herein, the chelating agents are also effective in decolorizing hydrophilic stains on which the surface bleaches herein are not highly effective.

OPTIONAL COMPONENTS

Surfactants

Because of the relatively poor dispersibility of the surface active peroxyacid bleaches of the invention in water, it is important that surfactants be present in the bleaching solutions in which the peroxyacids are used. The compositions herein are particularly suitable for use with anionic surfactants. Anionic surfactants should generally be present in the bleaching solution at a level of at least 150 ppm.

It is the usual practice to bleach fabrics in a laundering solution which contains a laundry detergent. Such detergents typically contain anionic surfactants and are generally used at solution concentrations which provide more than about 150 ppm anionic surfactant to the solution. Thus, if the bleach compositions herein are to be used with an anionic surfactant-containing laundry detergent there is no need to incorporate a surfactant into the bleach composition.

If anionic surfactants are incorporated into the bleach compositions herein they will generally be present at levels of from about 0.5% to about 30%, preferably from about 2.0% to about 10.0% of the composition. Examples of suitable anionic surfactants are given below.

Water-soluble salts of the higher fatty acids, i.e., "soaps," are useful as the anionic surfactant herein. This class of surfactants includes ordinary alkali metal soaps such as the sodium, potassium, ammonium and alkanolammonium salts of higher fatty acids containing from about 8 to about 24 carbon atoms.

Another class of anionic surfactants includes water-soluble salts, particularly the alkali metal, ammmonium and alkanolammonium salts, of organic sulfuric reaction products having in their molecular structure an alkyl group containing from about 8 to about 22 carbon atoms and a sulfuric acid or sulfuric acid ester group. (Included in the term "alkyl" is the alkyl portion of acyl groups.) Examples of this group of synthetic surfactants which can be used in the present invention are the sodium and potassium $C_{10}$ to $C_{20}$ alkyl sulfates, and sodium and potassium alkyl benzene sulfonates, in which the alkyl group contains from about 9 to about 15 carbon atoms in straight chain or branched chain configuration, e.g., those of the type described in U.S. Pat. No. 2,220,099, Guenther et al., issued Nov. 5, 1940; and U.S. Pat. No. 2,477,383, Lewis, issued July 26, 1949, incorporated herein by reference.

Other types of surfactants can be combined with the anionic surfactants herein. These include surfactants of the nonionic, ampholytic and zwitterionic types.

Nonionic surfactants include the water-soluble ethoxylates of $C_{10}$–$C_{20}$ aliphatic alcohols and $C_6$–$C_{12}$ alkyl phenols. Many nonionic surfactants are especially suitable for use as suds controlling agents in combination with anionic surfactants of the type disclosed herein.

Semi-polar surfactants are a preferred type of surfactants for use herein and include water-soluble amine oxides containing one alkyl moiety of from about 10 to about 28 carbon atoms and 2 moieties selected from the group consisting of alkyl groups and hydroxyalkyl groups containing from 1 to about 3 carbon atoms; water-soluble phosphine oxides containing one alkyl moiety of about 10 to about 28 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 28 carbon atoms and a moiety selected from the group consisting of alkyl and hydroxyalkyl moieties of from 1 to 3 carbon atoms.

Ampholytic surfactants include derivatives of aliphatic amines or aliphatic derivatives of heterocyclic secondary and tertiary amines in which the aliphatic moiety can be straight chain or branched and wherein one of the aliphatic substituents contains from about 8 to about 18 carbon atoms and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to about 18 carbon atoms and one contains an anionic water-solubilizing group.

Additional disclosures of suitable surfactants can be found in U.S. Pat. Nos. 4,145,184; 4,141,841; 4,132,680; 4,131,558; 4,123,377; 4,155,292; 4,113,644; 4,111,855; 4,101,457; 4,051,046; 3,892,681; 3,790,482; 3,749,674; 3,749,673; 3,715,314; and 3,630,923, all incorporated by reference herein.

Detergency Builders

The inorganic polyphosphate builders herein are the alkali metal tripolyphosphates, pyrophosphates and metaphosphates, e.g., sodium tripolyphosphate, potassium pyrophosphate and sodium metaphosphate. These builders theoretically tie up one mole of calcium or magnesium hardness per mole of builder, i.e., the stoichiometric ratio of builder to hardness is 1:1. In bleaching solutions utilizing the compositions of the invention, the molar ratio of inorganic polyphosphate to hardness ions (i.e., magnesium plus calcium) should be from 0.3 to about 3.0.

As noted above, it is the usual practice to bleach fabrics in a laundering solution which contains a laundering detergent. Such detergents, in addition to surfactants, typically contain a polyphosphate builder, and should preferably be used at concentrations which provide a builder:hardness ion molar ratio of at least 1:1. Thus, if the bleach compositions of the present invention are to be used with a polyphosphate builder-containing detergent, there is no need to incorporate such a builder into the bleach composition. If inorganic polyphosphate builders are incorporated into the bleach compositions herein, they will normally be present at levels of from about 0.5% to about 75% of the composition.

In addition to polyphosphate builders, the instant compositions can also contain additional detergency builders commonly taught for use in laundry compositions. These include, for example, inorganic silicates, carbonates and borates, as well as alkali metal aluminosilicates (zeolites). See U.S. Pat. No. 2,882,243, Milton, issued Apr. 14, 1959, incorporated by reference herein.

Stabilizers

The peroxyacid compositions of the present invention can contain various chelating agents which function as stabilizers in addition to the aminophosphonates and aminocarboxylate chelators specified hereinabove. These stablizers are primarily to protect the peroxyacids against decomposition which is catalyzed by heavy metals such as iron and copper. Such stabilizing agents are preferably present at levels of from about 0.005% to about 1.0% of the composition. Certain additional stabilizers and combinations of stabilizers are preferred. U.S. Pat. No. 3,442,937, Sennewald et al., issued May 6, 1969, discloses a chelating system comprising quinoline or a salt thereof, an alkali metal polyphosphate, and optionally, a synergistic amount of urea. U.S. Pat. No. 3,192,255, Cann, issued June 29, 1965, discloses the use of quinaldic acid to stabilize percarboxylic acids. This material, as well as picolinic acid and dipicolinic acid, are also useful in the compositions of the present invention. Particularly preferred stabilizer systems for the present invention are mixtures of either 8-hydroxyquinoline or dipicolinic acid with an acid polyphosphate, preferably acid sodium pyrophosphate. The latter may be a mixture of phosphoric acid and sodium pyrophosphate wherein the ratio of the former to the latter is from about 0.2:1 to about 2:1 and the ratio of the mixture to either 8-hydroxyquinoline or dipicolinic acid is from about 1:1 to about 5:1. The foregoing patents relating to stabilizers are incorporated herein by reference.

Coatings

The surface active peroxyacid bleaches of the invention can be coated with coating materials in order to give added protection against excessive moisture and other environmental factors which may tend to cause deterioration of the bleaches when stored for long peroids of time. Such coating materials may be in general, acids, esters, ethers and hydrocarbons and include such a wide variety of materials as fatty acids, derivatives of fatty alcohols such as esters and ethers, and hydrocarbon oils and waxes. These materials aid in preventing moisture from reaching the peroxyacid compound. Secondly, the coating may be used to segregate the peroxyacid compound from other agents which may be present in the composition and which could adversely affect the peroxyacid's stability. The amount of the coating material used is generally from about 2.5% to about 15% based on the weight of the peroxyacid compound. Coatings are generally not used if the peroxyacid bleach is in the form of a urea adduct.

Additional Bleaches

In addition to the organic surface active peroxyacid bleach which is an essential component of the compositions herein, the said compositions can also contain other organic peroxyacid bleaches. These include, for example, diperoxydodecanedioic acid, diperoxyazaleic acid, peroxybenzoic acid and metachloroperoxybenzoic acid. These peroxyacids can be present in the compositions herein at levels of from about 1% to about 200% by weight of the surface active peroxyacid.

Inorganic peroxygen bleaches (e.g., sodium perborate, sodium percarbonate, potassium monopersulfate, etc.) are preferably not present in the compositions herein. Accordingly, the said compositions herein are preferably substantially free of inorganic peroxygen bleaches.

Exotherm Control Agents

When subjected to excessive heat, organic peroxyacids can undergo a self-accelerating decomposition which can generate sufficient heat to ignite the peroxyacid. For this reason, it is desirable to include an exotherm control agent in peroxyacid bleaching compositions. Suitable materials include hydrates of potassium aluminum sulfate and aluminum sulfate. A preferred exotherm agent is boric acid (See U.S. Pat. No. 4,100,095, Hutchins, issued July 11, 1978, incorporated herein by reference). The exotherm control agent is preferably used in the composition at a level of from about 50% to about 400% of the amount of peroxyacid.

Miscellaneous

Various other optional ingredients such as dyes, optical brighteners, perfumes, soil suspending agents, organic and inorganic bulking agents (e.g., starch and sodium sulfate), and the like may also be used in the compositions herein at the levels conventionally present in detergent and bleaching compositions.

COMPOSITION USAGE

The compositions herein are designed especially to be used in bleaching solutions which contain magnesium ions, although of course magnesium ions are not essential for the said compositions to perform a bleaching function. The aminophosphonates and aminocarboxylates interact with magnesium ions, such as, for example, are present in ordinary hard water, and thereby retard decomposition/deactivation of the bleach by magnesium ions. The compositions will typically be used at a level so as to achieve an available oxygen level in solution from the surface active peroxyacid of from about 1 ppm to about 20 ppm, preferably from about 4 to about 15 ppm.

When magnesium ions are present in solutions they will generally be present at concentrations of from about 17 ppm to about 340 ppm. The magnesium ions can come from the water source itself, i.e., as natural "hardness," and they can also come into the solution as part of the soil on the fabrics or as a component present in the detergent product which is used. The compositions herein are designed such that when they are used at a concentration to provide the above designated level of available oxygen from the surface active peroxyacid, they will inherently deliver a sufficient quantity of aminophosphonate or aminocarboxylate chelating agent to retard the decomposition and/or deactivation effects of the magnesium ions on the surface active peroxyacid bleach.

The invention will be illustrated by the following examples.

EXAMPLE 1

Urea Adduct Preparation

As indicated previously herein, the surface active peroxyacid bleaches are preferably utilized in the compositions herein in the form of the urea adduct. The preparation of such adduct is illustrated as follows. 3243 grams of an aqueous slurry containing 70% perlauric acid is prepared. To this slurry is added 6810 grams of finely divided urea. The mixture is thoroughly blended, then air-dried at 27° C./15% relative humidity. The weight ratio of urea to peroxyacid in the adduct is 3:1 and the adduct contains 1.7–1.9% available oxygen. The dried adduct is ground, and particles which pass through a 14 mesh screen and remain on a 65 mesh are collected for use.

EXAMPLE 2

Method of Kinetic Testing

To 1 liter of distilled water in a Tergotometer® (United States Testing Co., Inc.) is added a volume of a stock solution of calcium nitrate and/or magnesium nitrate such that the desired type and level of water hardness is obtained. The solution is then heated to 100° F. To this solution is added an amount of a detergent composition which provides 250 ppm of sodium linear alkyl benzene sulfonate ($C_{13}$ chain length), 488 ppm sodium tripolyphosphate, 0–10 ppm of aminophosphonate or aminocarboxylate chelator and an amount of peroxyacid sufficient to provide 5 ppm AvO. The linear alkyl benzene sulfonate and the sodium tripolyphosphate are added as a single particle, and the additional chelator is added from a stock solution. Perlauric acid is added as a urea adduct prepared in the manner described in Example 1. Peroxyacid is added in the form of a prilled particle, which has been screened through 14 mesh, onto 65 mesh. After addition of the peroxyacid, the pH of the solution is adjusted with acid or base to 8.5 and the agitator is turned on. Aliquots of the solution are taken at 1, 3, and 5 minutes (measured from the time of addition of peroxyacid), quenched in acetic acid, and titrated for available oxygen with sodium thiosulfate, using potassium iodide as the indicator. Each kinetic run is replicated 3 times, and the values reported are averages of the 3 runs.

EXAMPLE 3

Using the testing procedure in Example 2, it was found that the presence of magnesium ion (111 ppm expressed as magnesium carbonate) at 1:1 molar equivalents to sodium tripolyphosphate causes a faster rate of decomposition of perlauric acid (initial AvO=5 ppm) than if no magnesium is present. The presence of Dequest 2041 [ethylenediaminetetra(methylphosphonic acid)] at substoichiometric quantities (3 ppm, 0.0102 mM) mitigates the faster decomposition. See data in Table 1.

TABLE 1

| Time (Min.) | Perlauric Acid, ppm AvO: 0 ppm $Mg^{+2}$ | 111 ppm $Mg^{+2}$ | 111 ppm $Mg^{+2}$ 3 ppm Deq. 2041 |
|---|---|---|---|
| 1.0 | 4.6 | 4.6 | 4.7 |
| 3.0 | 4.6 | 4.3 | 4.6 |
| 5.0 | 4.6 | 4.2 | 4.5 |

EXAMPLE 4

Using the testing procedure in Example 2, it was found that the presence of calcium (133 ppm expressed as calcium carbonate) at a 1:1 molar equivalent to sodium tripolyphosphate caused a faster rate of decomposition than when no calcium was present. The addition of substoichiometric quantities of Dequest 2041 (3 ppm) did not mitigate the decomposition effect of calcium. See data in Table 2.

TABLE 2

| Time (Min.) | Perlauric Acid, ppm AvO: 0 ppm $Ca^{+2}$ | 133 ppm $Ca^{+2}$ | 133 ppm $Ca^{+2}$ 3 ppm Deq. 2041 |
|---|---|---|---|
| 1.0 | 4.6 | 4.6 | 4.6 |
| 3.0 | 4.6 | 3.5 | 3.4 |

TABLE 2-continued

| Time (Min.) | Perlauric Acid, ppm AvO: 0 ppm $Ca^{+2}$ | 133 ppm $Ca^{+2}$ | 133 ppm $Ca^{+2}$ 3 ppm Deq. 2041 |
|---|---|---|---|
| 5.0 | 4.6 | 2.3 | 2.3 |

EXAMPLE 5

Using the testing procedure in Example 2 and 1:1 molar equivalent of magnesium ion and sodium tripolyphosphate, Dequest 2000 [aminotri(methylphosphonic acid)] and Dequest 2060 [diethylenetriaminepenta(methylphosphonic acid)] show the same retardation of decomposition of perlauric acid (initial AvO=5 ppm) as Dequest 2041. See data in Table 3.

TABLE 3

| Time (Min.) | Perlauric Acid, ppm AvO: $Mg^{+2}$* | $Mg^{+2}$* .0102 mM** Deq. 2041 | $Mg^{+2}$* 0.0100 mM** Deq. 2000 | $Mg^{+2}$* .0052 mM** Deq. 2060 |
|---|---|---|---|---|
| 1.0 | 4.6 | 4.7 | 4.8 | 4.7 |
| 3.0 | 4.3 | 4.6 | 4.6 | 4.6 |
| 5.0 | 4.2 | 4.5 | 4.5 | 4.5 |

*111 ppm as $MgCO_3$
**mM = millimoles at concentration of 3 ppm

EXAMPLE 6

Using the testing procedure in Example 2, the addition of low levels of sodium tripolyphosphate (3 ppm, 0.0082 mM) in excess of the amount needed to achieve 1:1 molar equivalence with magnesium ion, was found not to retard the decomposition rate of perlauric acid (initial AvO=5 ppm). However, the addition of a large excess of sodium tripolyphosphate (1.34 mM, 100% excess over the amount of $Mg^{+2}$) did retard the decomposition rate. See data in Table 4.

TABLE 4

| Time (Min.) | Perlauric Acid, ppm AvO: $Mg^{+2}$ 0 ppm | $Mg^{+2}$ 111 ppm | $Mg^{+2}$ 111 ppm (.0082 mM) +3 ppm STP | $Mg^{+2}$ 111 ppm (1.34 mM) +488 ppm STP |
|---|---|---|---|---|
| 1.0 | 4.6 | 4.6 | 4.4 | 4.7 |
| 3.0 | 4.6 | 4.3 | 4.3 | 4.6 |
| 5.0 | 4.6 | 4.2 | 4.2 | 4.5 |

EXAMPLE 7

Using the testing procedure in Example 2, it was found that the presence of magnesium ion at an equivalent level to sodium tripolyphosphate did not affect the decomposition of diperoxy dodecanedioic acid (initial AvO=5 ppm). See data in Table 5.

TABLE 5

| Time (Minutes) | DPDA, ppm AvO: 0 ppm $Mg^{+2}$ | 111 ppm $Mg^{+2}$ |
|---|---|---|
| 1.0 | 4.9 | 4.8 |
| 3.0 | 4.9 | 4.8 |
| 5.0 | 4.8 | 4.7 |

EXAMPLE 8

In this example the same testing procedure of Example 2 was used, except that the detergent system used was one which delivers 54 ppm $C_{12}$ sodium linear alkylbenzene sulfonate, 85 ppm sodium tallow alkyl sulfate, 85 ppm sodium alkyl ethoxylated sulfate, 376 ppm sodium tripolyphosphate and 271 ppm zeolite clay and 162 ppm sodium carbonate. In addition, ballast fabrics soiled with an artificial body soil were added to the solution. It was found that Dequest 2041 retards the decomposition of perlauric acid (initial AvO=7 ppm) in 111 ppm $Mg^{+2}$ in this detergent system also. See data in Table 6.

TABLE 6

| Time (Minutes) | Perlauric Acid, ppm AvO: 111 ppm $Mg^{+2}$ | Perlauric Acid, ppm AvO: 111 ppm $Mg^{+2}$ 10 ppm Deq. 2041 |
|---|---|---|
| 1.0 | 6.3 | 6.1 |
| 3.0 | 2.1 | 3.0 |
| 5.0 | 1.9 | 2.5 |

EXAMPLE 9

Using the same procedure and detergent system as described in Example 8, it was found that Dequest 2041 retards the decomposition of perlauric acid (initial AvO=7 ppm) in the presence of a mixed $Ca^{+2}/Mg^{+2}$ system (103 ppm $Ca^{+2}$ calculated as $CaCO_3$ and 43 ppm $Mg^{+2}$ calculated as $MgCO_3$). See data in Table 7.

TABLE 7

| Time (Min.) | Perlauric Acid, ppm AvO: 103 ppm $Ca^{+2}$/ 43 ppm $Mg^{+2}$ | Perlauric Acid, ppm AvO: 103 ppm $Ca^{+2}$/ 43 ppm $Mg^{+2}$ +3 ppm Deq. 2041 |
|---|---|---|
| 1.0 | 3.8 | 4.7 |
| 3.0 | 1.6 | 2.2 |
| 5.0 | 1.1 | 1.6 |

EXAMPLE 10

Method of Performance Testing

Soiled fabrics, which have been obtained from consumers, are split in half and washed in different treatments. The standard test procedure utilizes four treatments, with round-robin comparisons. In other words, for four treatments (A, B, C, D) the following paired comparisons are graded: AB, AC, AD, BC, BD, CD, BA, CA, DA, CB, DB, DC (the last six are the reverse of the first six). In this example, only two of the treatments were of interest, thus, data on only two of the direct pairs (i.e., AB and BA are reported. After the fabrics are washed in their respective treatments in normal size washing machines on a regular cycle which also contains a normally soiled laundry bundle, they are dried and the pairs are placed back together and visually graded by a panel of judges on a 0 (no difference) to 4 (very large difference) scale for whitening/brightening. Performance is judged on three separate fabrics: dingy t-shirts, dingy shirts, and dingy sheets. There are five judges per test and a total of ten replicated tests. Thus, the results reported are the average of 300 grades on 60 pairs.

Using this procedure, the following treatments were compared. The wash water in both treatments was made up with 111 ppm $Mg^{+2}$ (expressed as $MgCO_3$) which is a 1:1 molar ratio with the amount of STP present. The wash temperature was 38° C.

| | ppm Delivered to Wash: Treatment A | ppm Delivered to Wash: Treatment B |
|---|---|---|
| $C_{13}$LAS | 250 | 250 |
| STP | 488 | 488 |
| Perlauric Acid | 5.0 ppm AvO | 5.0 ppm AvO |
| Dequest 2041 | — | 3.0 |

The fabrics from Treatment B had a whiteness score 0.29 units higher than the fabrics from Treatment A. This difference is statistically significant at a 10% risk factor. The AvO decomposition profile is shown in Table 8.

TABLE 8

| Time (Min.) | Perlauric Acid, ppm AvO: Treatment A | Perlauric Acid, ppm AvO: Treatment B |
|---|---|---|
| Initial (0.5–1.0) | 4.5 | 5.1 |
| 5.0 | 1.5 | 1.8 |
| Final (~12.0) | 0.7 | 0.75 |

The slower decomposition in the wash with Dequest 2041 corresponded to higher whitening performance for Treatment B. A decrease in the nonuseful decomposition of available oxygen results in more oxygen being available to react with soil, thereby resulting in better bleaching.

0.3 ppm AvO difference in kinetic tests (Examples 3–7) only results in 8–10% increase in level of AvO. However, due to the presence of soil included in the kinetic tests of Examples 8 and 9 and the performance test of Example 10 (soil results in increased perlauric acid decomposition by an independent path), the 0.3 ppm AvO increase equates to ≧20% increase in AvO through the majority of the wash. This results in significantly increased performance.

EXAMPLE 11

This example illustrates the stain removal ability of the organic chelator compounds on hydrophilic stains.

Bolts of cotton muslin were uniformly soiled with solutions of gravy, chocolate, coffee, tea and grape juice, respectively. Enough 12.7 sq. cm. square swatches were cut from the bolts so that there were 2 swatches per stain for each composition to be tested.

Wash loads containing sets of the stained swatches were washed in an automatic mini washer having a wash volume of 6 liters, a 10 minute wash cycle and a 2 minute rinse cycle. The water hardness was 50 ppm (as $CaCO_3$) at a 3:1 weight ratio of calcium to magnesium and the wash temperature was 32° C. A ballast load of four 28 cm.×30.5 cm. white terrycloth fabrics (84% cotton/16% polyester) was added to each wash load.

After washing, rinsing and drying three times, the swatches were graded on a Gardner color meter. Stain removal was determined by the difference in light reflectance readings before and after washing. The percent stain removal was calculated as the percent return to the coordinates of the unsoiled fabric along the same path in color space followed in the staining of the cloth.

The concentrations of the principal ingredients in the wash solutions for the four treatments tested are shown in Table 9.

TABLE 9

| Treatment | ppm in Wash Solution | | | |
|---|---|---|---|---|
| | A | B | C | D |
| $C_{13}$ linear alkyl benzene sulfonate | 250 | 250 | 250 | 250 |
| $Na_2CO_3$ | 200 | 200 | 200 | 200 |
| Na tripolyphosphate | 488 | 488 | 488 | 488 |
| Perlauric acid (ppm Av.O) | — | 3 | — | 3 |
| Versenex 80* | — | — | 50 | 50 |

*Diethylenetriaminepentaacetic acid

The stain removal results for these treatments expressed as difference in percent stain removal (%) compared to treatment A are shown in Table 10.

TABLE 10

| Treatment | A | B | C | D |
|---|---|---|---|---|
| Gravy | 0 | 6.5 | 2.5 | 9.0 |
| Chocolate | 0 | 4.5 | 8.5 | 9.5 |
| Coffee | 0 | 6.5 | 9.5 | 14.0 |
| Tea | 0 | 21.0 | 29.0 | 38.5 |
| Grape Juice | 0 | 2.0 | 10.0 | 12.0 |

What is claimed is:

1. A dry granular bleaching composition comprising:

A. from about 0.8% to about 25% of a surface active peroxyacid bleach of the formula $R_1CO_3H$ wherein $R_1$ is an alkyl group containing from about 7 to about 21 carbon atoms; and B. from about 0.1% to about 2% of an organic chelating agent selected from the group consisting of aminotri(methylphosphonic acid), ethylenediaminetetra(methylphosphonic acid), diethylenetriamine penta(methylphosphonic acid and the alkali metal salts thereof.

2. The composition of claim 1 wherein the surface active peroxyacid bleach is in the form of a urea adduct which contains from about 20% to about 25% of said bleach.

3. The composition of claim 2 wherein the weight ratio of organic chelator to available oxygen provided by the surface active peroxyacid bleach is from about 0.025:1 to about 20:1.

4. The composition of claims 2 or 3 wherein the weight ratio of organic chelator to available oxygen provided by the surface active peroxyacid bleach is from about 0.4:1 to about 2:1.

5. The composition of claim 4 which contains from about 0.5% to about 30% of an anionic surfactant.

6. The composition of claim 5 which contains from about 0.5% to about 75% of an inorganic polyphosphate detergency builder.

7. A method of bleaching fabrics comprising the step of contacting said fabrics at a temperature of from about 15° C. to about 52° C. with an aqueous solution comprising:

A. from about 1 ppm to about 20 ppm of available oxygen from a surface active peroxyacid bleach of the formula $R_1CO_3H$ wherein $R_1$ is an alkyl group containing from about 7 to about 21 carbon atoms; and B. an amount of an organic chelator which is in a weight ratio of from about 0.025:1 to about 20:1 to said available oxygen, the said chelator being selected from the group consisting of aminotri(methylphosphonic acid), ethylenediaminetetra(methylphosphonic acid), diethylenetriamine penta(methylphosphonic acid and the alkali metal salts thereof.

C. at least about 150 ppm anionic surfactant;

D. from about 17 ppm to about 340 ppm magnesium hardness ion; and

E. an amount of inorganic polyphosphate builder which is from 0.3 to about 3 times the theoretical stoichiometric equivalent of the total amount of magnesium ion and any calcium which may be present in said solution.

8. The method of claim 7 wherein the active bleach is one wherein $R_1$ is from about 9 to about 13.

9. The method of claim 8 wherein the weight ratio of organic chelator to available oxygen provided by the surface active peroxyacid bleach is from about 0.4:1 to about 2:1.

10. The method of claim 9 wherein the amount of anionic surfactant is from about 200 ppm to about 400 ppm.

11. The method of claim 10 wherein the surface active bleach is perlauric acid.

* * * * *